US006428742B1

(12) United States Patent
Lemken

(10) Patent No.: US 6,428,742 B1
(45) Date of Patent: Aug. 6, 2002

(54) METHOD FOR HEAT-TREATING METALLIC WORKPIECES

(75) Inventor: Karl-Heinz Lemken, Kleve (DE)

(73) Assignee: Ispen International GmbH, Kleve (DE)

( * ) Notice: Subject to any disclaimer, the term of this patent is extended or adjusted under 35 U.S.C. 154(b) by 33 days.

(21) Appl. No.: 09/653,993

(22) Filed: Sep. 1, 2000

(30) Foreign Application Priority Data

Sep. 24, 1999 (EP) ..... 99118920

(51) Int. Cl.[7] ..... C21D 11/00

(52) U.S. Cl. ..... 266/78; 266/259; 148/209; 432/176

(58) Field of Search ..... 266/78, 259; 148/508, 148/509; 432/176, 1, 38, 42, 47, 48; 417/280

(56) References Cited

U.S. PATENT DOCUMENTS 4,141,539 A * 2/1979 Bornor ..... 266/78
5,478,985 A * 12/1995 Hoetzl et al. ..... 432/176

FOREIGN PATENT DOCUMENTS

| | | |
|---|---|---|
| DE | 200995 | 6/1907 |
| DE | 649125 | 8/1937 |
| EP | 0313888 | 5/1989 |
| EP | 0798391 | 10/1997 |

* cited by examiner

*Primary Examiner*—Scott Kastler
(74) *Attorney, Agent, or Firm*—Smith, Gambrell & Russell, LLP

(57) ABSTRACT

A method for heat-treating metallic workpieces, in which a flow of cooling gas is generated in a vacuum furnace by a fan in order to quench the workpieces, with the fan being driven by a rotary current motor that is operated with a predetermined supply voltage above a minimum pressure in the vacuum furnace which is determined with regard to the motor power of the rotary current motor. In order to additionally develop this method such that a simple and inexpensive improvement of the quenching effect is achieved, the fan is started at a pressure in the vacuum furnace which is lower than the minimum pressure, with the rotary current motor being operated with a second, lower supply voltage until the minimum pressure in the vacuum furnace is reached.

22 Claims, 3 Drawing Sheets

METHOD FOR HEAT-TREATING METALLIC WORKPIECES

INTRODUCTION AND BACKGROUND

The present invention pertains to a method for heat-treating metallic workpieces, in which a flow of cooling gas is generated in a vacuum furnace by a fan in order to quench the workpieces, with the fan being driven by a rotary current motor that is operated with a predetermined supply voltage above a minimum pressure in the vacuum furnace, which pressure is determined with regard to the motor power of the rotary current motor.

In the heat treatment of metallic workpieces, e.g., hardening, tempering or annealing, vacuum furnaces are increasingly utilized. The workpieces are cooled in these vacuum furnaces by a gaseous medium, e.g., nitrogen, after being heated. In comparison to conventional oil bath quenching or salt bath quenching methods, such a gas quenching provides the advantage that no contamination of the workpieces occurs, i.e., costly cleaning measures are eliminated. In order to achieve cooling effects similar to those of the oil bath quenching or salt bath quenching method during the gas quenching, it is known to provide high cooling gas pressures that ensure the desired heat transfer due to the increased gas density associated therewith. However, high cooling gas pressures require complicated safety measures, with the time required for flooding or evacuating the vacuum furnace also being relatively long.

Another disadvantage that occurs during high-pressure gas quenching can be seen in the fact that the fan used for generating the flow of cooling gas in the vacuum furnace requires a comparatively high shaft output so as to ensure the required cooling gas speed for the load moments occurring at high pressures. A high shaft output also makes it necessary to achieve a high motor power of the electric motor driving the fan. Consequently, this electric motor is usually realized in of the form of a rotary current motor with a rated power of, for example, 220 kW. A rated motor power of 220 kW results in a rated motor current of 400 A at a supply voltage of approximately 400 V. When the fan is started, a starting current of 3600 A is created due to the surges which occur during this process and which usually amount up to nine times the rated motor current under standard conditions of the cooling gas.

High currents of this type frequently result in network interruptions and high wear, primarily at the connecting points. This is prevented by utilizing starting devices for realizing a so-called soft start of the rotary current motor. This is achieved by limiting the starting current, e.g., to five times or six times the rated motor current. However, such starting devices are associated with higher costs and consequently not considered satisfactory with respect to economic considerations.

Although the soft start of the electric motor driving the fan makes it possible to quench the workpieces to be treated at low furnace pressures, i.e., during the flooding of the vacuum furnace, the beginning of the quenching process is subject to a lower limit with respect to time. This can be attributed to the fact that the vacuum furnace needs to be flooded to a minimum pressure which is defined with regard to the supply voltage of the rotary current motor before the fan can be started. This measure serves for preventing the occurrence of, for example, flashovers that result in insulation damages. For rotary current motors with a motor supply voltage of 400 V, the minimum pressure which can be determined with the aid of so-called Paschen curves usually lies at approximately 750 mbar.

Since the fan can only be started once the minimum pressure during the flooding of the vacuum furnace with a cooling gas is reached, the quenching time and consequently the attainable quenching effect are disadvantageously influenced due to the unavoidable starting time of the fan.

An object of the invention is to develop a method for heat-treating metallic workpieces in such a way that an improved quenching effect can be achieved in a simple and inexpensive fashion.

SUMMARY OF THE INVENTION

The above and other objects of the invention can be attained due to the fact that the fan is started at a pressure in the vacuum furnace which is lower than the minimum pressure that can be selected, for example, from the range of 500–1200 mbar with the rotary current motor being operated with a second, lower supply of voltage until the minimum pressure in the vacuum furnace is reached.

Such a method makes it possible to achieve an improved quenching effect. The primary cause for this is that shorter quenching times which allow a higher variability with respect to the desired quenching behavior for the respective workpieces to be treated can be achieved due to the start of the fan at a pressure in the vacuum furnace which is lower than the minimum pressure.

A feature of the invention is that a start of the fan at pressures below the minimum pressure is possible without risking flashovers if the rotary current motor is operated with a lower supply voltage than required for the shaft output of the fan necessary for the stipulated cooling gas speed. The reduced supply voltage also reduces the starting current, i.e., a starting device that makes it possible to realize a soft start can be eliminated. Although the lower supply voltage also reduces the motor power, the motor power suffices for starting the fan due to the low pressure in the vacuum furnace and the low density of the cooling gas associated therewith.

Once the minimum pressure in the vacuum furnace is reached, the fan is operated with the higher supply voltage. Since the fan already rotates with its nominal speed at this time, the shaft output required for quenching the workpieces is immediately available once the change-over to the higher supply voltage takes place, namely without impairing the quenching effect due to the time loss caused by the starting of the fan as is the case with the state of the art. In this respect, it is particularly advantageous for kinetic energy to be already stored in the fan before the minimum pressure in the vacuum furnace is reached due to the rotation of the fan, with said kinetic energy manifesting itself in the form of a flywheel effect when the change-over to the higher supply voltage takes place. Due to the lower starting currents, the method according to the invention also contributes to a more favorable current consumption with respect to economic considerations and makes it possible to eliminate very high quenching pressures that are difficult to realize while still achieving a comparable quenching effect.

It is particularly advantageous if the supply voltage is applied to the rotary current motor and decreased from a higher to a lower supply voltage and increased vice versa by a transformer. The voltage transformation by means of a transformer is comparatively inexpensive and makes it possible to easily retrofit existing heat treatment systems such that the method according to the invention can be carried out. For the same purpose, the invention proposes that the rotary current motor be operated with a supply voltage of approximately 400 V above the minimum pressure and with a supply voltage of approximately 230 V below the minimum pressure.

According to one preferred additional development of the invention, the supply voltage applied to the rotary current motor is changed depending on the pressure in the vacuum furnace and/or the intensity of the current flowing through the rotary current motor so as to ensure that the method can be carried out as easily as possible and automated. In an additional development of the invention, a minimum pressure of 750 mbar is proposed such that the motor power of the most common rotary current motors for fans used in vacuum furnaces is taken into consideration.

In order to allow the utilization of powerful rotary current motors, the rotary current motor is cooled with water according to another characteristic of the invention. A simple control of the cooling gas flow can be achieved by varying the speed of the fan above the minimum pressure depending on the desired cooling gas speed. The invention also proposes that the fan be operated at pressures in the vacuum furnace up to 40 bar so as to ensure cooling gas pressures that correspond to the respective requirements while still achieving a sufficient quenching effect.

The aforementioned amendments do not add any new matter to the application. The new paragraph on page 3 of the specification reiterates the minimum pressure range detailed in the originally filed claims. The new paragraph on page 5 details that the fan can be operated at pressures in the vacuum furnace up to 40 bar, which is also supported by the originally filed claims.

BRIEF DESCRIPTION OF DRAWINGS

The present invention will be further understood with reference to the drawings, wherein.

DETAILED DESCRIPTION OF INVENTION

Figure 1A:
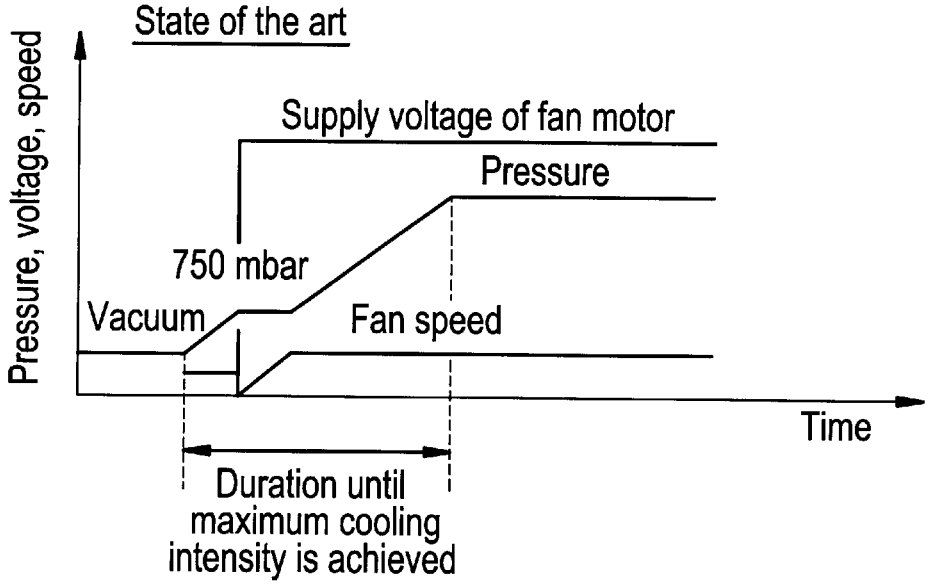
FIG. 1*a* is a graph representing a chronology with respect to furnace pressure, fan speed and voltage according to the state of the art.

Details and additional advantages of the object of the present invention result from the following exemplary description of a method for case-hardening metallic workpieces.

The case-hardening process serves for providing the boundary layer of metallic workpieces with a significantly higher hardness, i.e., for providing the entire workpiece with superior mechanical properties. For this purpose, the boundary layer is initially enriched with carbon and/or nitrogen depending on the required characteristics of use and subsequently quenched to room temperature or below from an appropriate hardening temperature. An acceptable case-hardening with respect to the procedural technology can be achieved if the carbonizing or carbonitriding as well as the subsequent hardening are carried out in a vacuum furnace that allows a simple exchange of gaseous heat treatment mediums.

After the workpieces to be treated are, for example, carbonized in the vacuum furnace, the hardening process can be included immediately thereafter by evacuating the gaseous carbonizing medium and subsequently flooding the vacuum furnace with an inert cooling gas, namely without having to transport the workpieces into another furnace chamber. An electrically driven fan that generates a cooling gas flow with a cooling gas speed that corresponds to the respective requirements is provided for hardening the workpieces in the vacuum furnace. The cooling gas flow quenches the workpieces to be treated from the hardening temperature to room temperature or below.

A rotary current motor with a rated power of 200 kW is provided for driving the fan. This rotary current motor is operated with a supply voltage of 230 V if the pressure in the vacuum furnace lies below 750 mbar and with a supply voltage of 400 V if the pressure in the furnace exceeds 750 mbar. A starting transformer reduces the supply voltage to 230 V. A change-over from 230 V to 400 V takes place once a pressure of approximately 750 mbar is reached in the vacuum furnace during the flooding with a cooling gas. As long as the rotary current motor is supplied with a voltage of 230 V, the motor power amounts to merely one-third of the motor power available with the 400 V supply voltage, i.e., 73.3 kW in this case. Due to this measure, the rated motor current drops from a value of 400 A at a motor power of 220 kW to approximately half of the original value. Correspondingly reduced starting currents result for the start of the fan, with said starting currents not impairing the power grid. Measurements demonstrated that the maximum occurring starting current lies at 1500 A, with said starting current occurring for a duration of 1–2 s. Due to the lowered starting currents, a comparatively lower current consumption is also ensured.

The supply voltage which is reduced to 230 V also precludes the risk of flashovers which would otherwise occur with a motor power of 220 kW at pressures below 750 mbar. In addition, the supply voltage that is reduced to 230 V makes it possible for the fan to be started at pressures below 150 mbar and for the full shaft output to be available once the latter-mentioned pressure is reached.

Figure 1B:
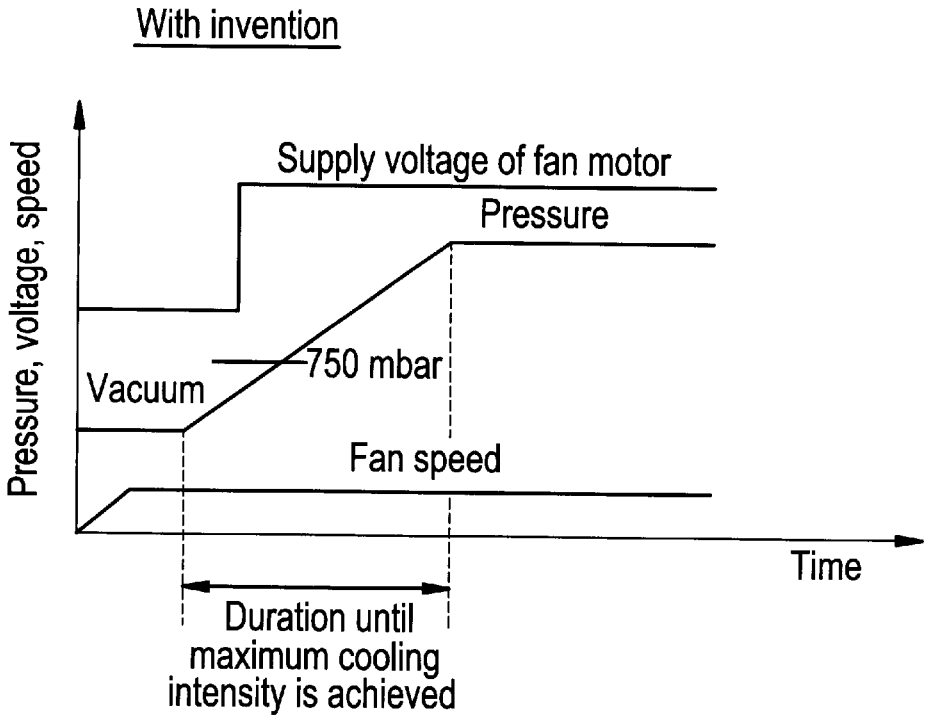
FIG. 1*b* is a graph representing a chronology with respect to furnace pressure, fan speed and voltage according to the present invention.

FIG. 1 shows the time history with respect to the furnace pressure, the fan speed and the supply voltage according to the state of the art and according to the invention for initiating the quenching process.

Since the conventional filling of the quenching container to a minimum pressure for starting the fan motor is eliminated, the chosen gas quenching pressure can be generated without delay. This results in a faster beginning of the cooling process with maximum cooling power such that a corresponding time advantage for reaching the desired cooling temperature is achieved. With identical material combinations, this results in an improved quenching result in comparison to the state of the art.

Figure 2:
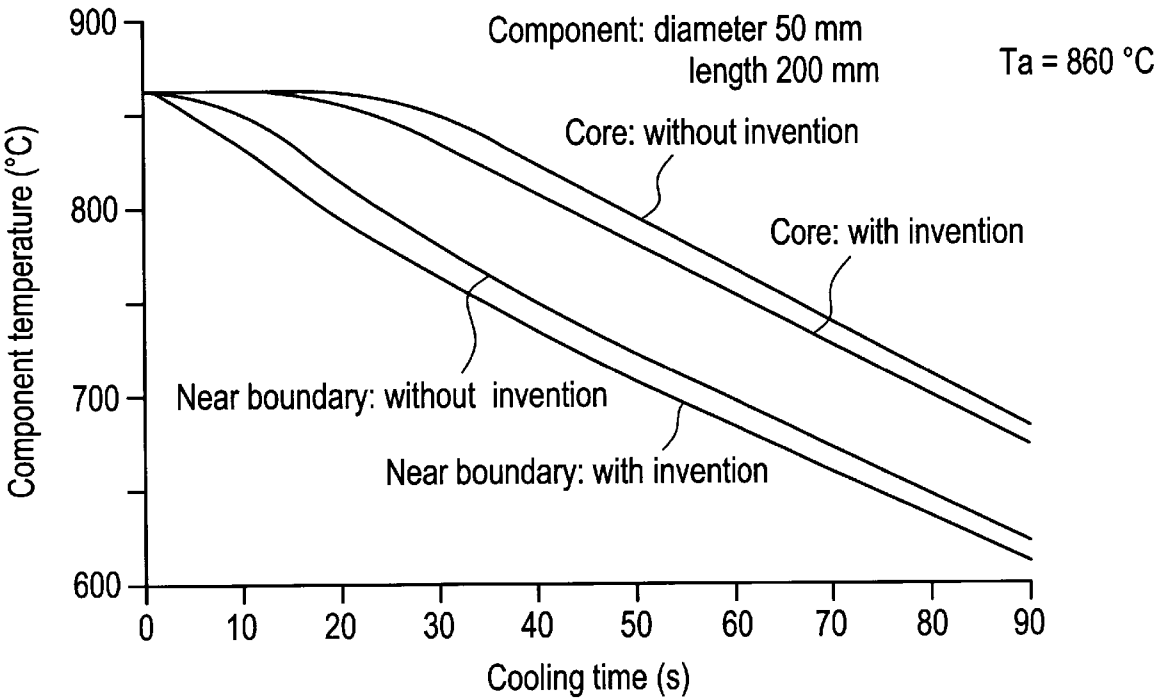
FIG. 2 is a graph of the temperature of the work piece versus cooling time according to the state of the art and according to the invention.

FIG. 2 shows corresponding measuring curves with respect to cooling processes with and without utilization of the invention.

Figure 3:
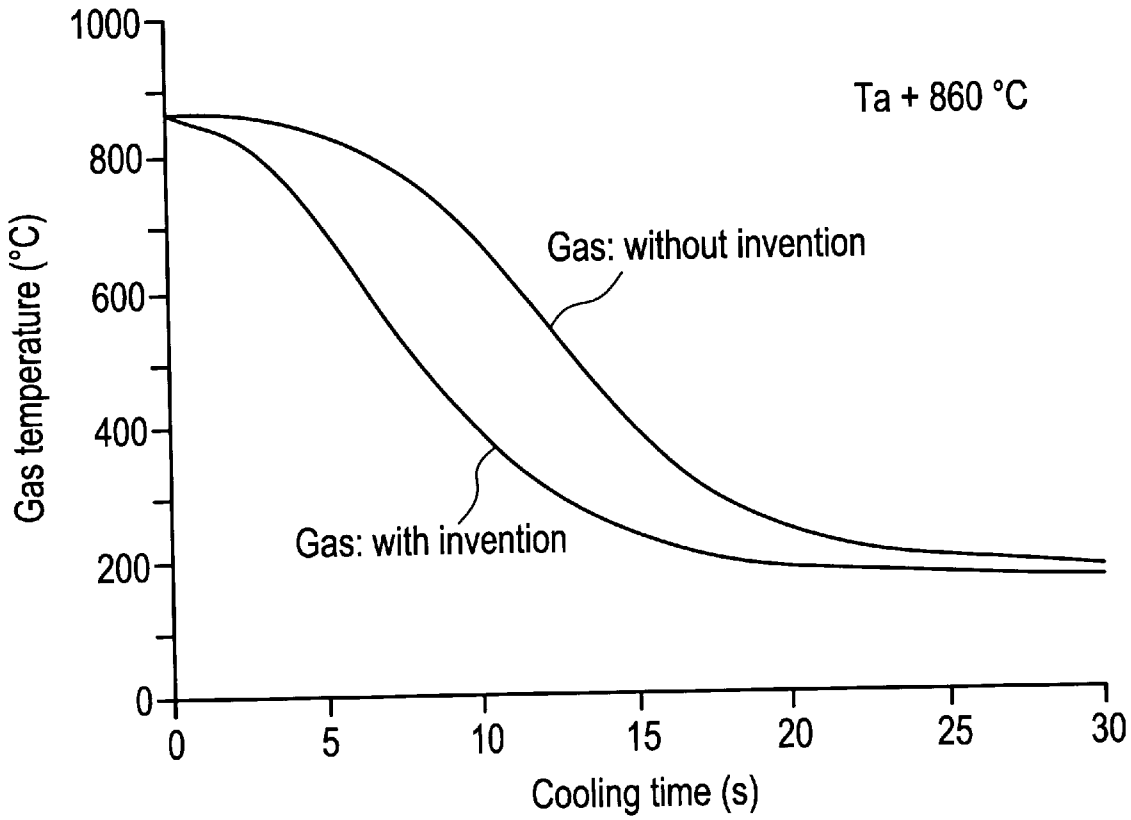
FIG. 3 is a graph of gas temperature versus cooling time according to the state of the art and according to the invention.

The continuous filling of the quenching container also results in a significantly faster cooling of the gas during the first minutes of the cooling process such that an improved heat transfer is achieved. The faster cooling of the gas achieved by utilizing the invention is illustrated in FIG. 3.

Since special steels to be case-hardened have a relatively low hardenability and consequently require a very fast cooling during the first minutes in order to achieve a sufficient quenching result, the invention is particularly suitable for these instances.

Further variations and modifications of the foregoing will be apparent to those skilled in the art and are intended to be encompassed by the claims appended hereto.

European priority application 99 11 8920.0 is relied on and incorporated herein by reference.

I claim:

1. Method for heat-treating metallic workpieces, comprising the following steps:

generating a cooling gas flow in a quenching chamber of a single-chamber or multi-chamber furnace which can be evacuated by means of a fan in order to quench the workpieces, driving the fan by a rotary current motor that is operated with a predetermined supply voltage when the quenching chamber is above a minimum pressure which is determined with regard to motor power of the rotary current motor, starting the fan at a pressure in the quenching chamber which is lower than the minimum pressure, with the rotary current motor being operated with a second, lower supply of voltage until a minimum pressure in the quenching chamber is reached.

2. Method according to claim 1, wherein the power supply voltage is applied to the rotary current motor and decreased from a higher to a lower supply voltage and increased vice versa by a transformer.

3. Method according to claim 1, wherein above the minimum pressure the rotary current motor is operated with a supply voltage of approximately 400 V and below the minimum pressure with a supply voltage of approximately 230 V.

4. Method according to claim 2, wherein above the minimum pressure the rotary current motor is operated with a supply voltage of approximately 400 V and below the minimum pressure with a supply voltage of approximately 230V.

5. Method according claim 1, wherein the supply voltage applied to the rotary current motor is changed depending on the pressure in the quenching chamber and/or the intensity of the current flowing through the rotary current motor.

6. Method according claim 2, wherein the supply voltage applied to the rotary current motor is changed depending on the pressure in the quenching chamber and/or the intensity of the current flowing through the rotary current motor.

7. Method according claim 3, wherein the supply voltage applied to the rotary current motor is changed depending on the pressure in the quenching chamber and/or the intensity of the current flowing through the rotary current motor.

8. Method according to claim 1, wherein the minimum pressure is from a range of 500–1200 mbar.

9. Method according to claim 2, wherein the minimum pressure is from a range of 500–1200 mbar.

10. Method according to claim 3, wherein the minimum pressure is from a range of 500–1200 mbar.

11. Method according to claim 4, wherein the minimum pressure is from a range of 500–1200 mbar.

12. Method according to claim 1, wherein the rotary current motor is cooled with water.

13. Method according to claim 2, wherein the rotary current motor is cooled with water.

14. Method according to claim 3, wherein the rotary current motor is cooled with water.

15. Method according to claim 4, wherein the rotary current motor is cooled with water.

16. Method according to claim 5, wherein the rotary current motor is cooled with water.

17. Method according to claim 1, wherein that above the minimum pressure the speed of the fan is varied depending on the desired cooling gas speed.

18. Method according to claim 1, wherein the fan is operated at pressures of up to 40 bar in the quenching chamber.

19. Method according to claim 1, further comprising quenching the workpieces by:

a) initiating the gas quenching by starting the rotary current motor of the fan at a pressure below 750 mbar, namely with a voltage that is lower than a rated supply voltage for the motor, b) accelerating the fan to a rated speed, c) flooding the quenching chamber with the quenching gas and adjusting the quenching pressure in the quenching chamber to a value between 1 and 40 bar, d) essentially simultaneous change-over of the supply voltage to the rated supply voltage of the motor once a pressure >750 mbar is reached in the quenching chamber, and e) ventilating the quenching chamber to atmospheric pressure and removing the workpieces after the gas quenching process.

20. Method according to claim 1, further comprising quenching the workpieces by:

a) initiating the gas quenching by starting the rotary current motor of the fan with 40% to 80% of a rated supply voltage for the rotary current motor at a pressure below 750 mbar, b) accelerating the fan to a rated speed, c) flooding the quenching chamber with the quenching gas and adjusting the quenching pressure in the quenching chamber to a value between 1 and 40 bar, d) essentially simultaneous change-over of the supply voltage to the rated supply voltage of the motor once a pressure greater than 750 mbar is reached in the quenching chamber, and e) ventilating the quenching chamber to atmospheric pressure and removing the workpieces after the gas quenching process.

21. Method for heat-treating metallic workpieces, comprising the following steps:

generating a cooling gas flow in a quenching chamber of a single-chamber or a multi-chamber furnace which can be evacuated by means of a fan to quench the workpieces, starting the fan with a rotary current motor using a low supply of voltage until a minimum pressure in the quenching chamber is reached, and driving the fan with the rotary current motor using a higher supply of voltage when the quenching chamber reaches the minimum pressure.

22. The method according to claim 21, further comprising the step of slowing the fan by using the low supply of voltage when the quenching chamber falls below the minimum pressure.

* * * * *